US005918755A

United States Patent [19]

Warn

[11] Patent Number: 5,918,755

[45] Date of Patent: Jul. 6, 1999

[54] APPARATUS AND PROCESS FOR ERECTING COLLAPSIBLE BIN

[75] Inventor: Jeffrey L. Warn, Ceres, Calif.

[73] Assignee: Calpine Containers, Inc., Pleasant Hill, Calif.

[21] Appl. No.: 09/010,804

[22] Filed: Jan. 22, 1998

[51] Int. Cl.[6] ..... B05D 7/02

[52] U.S. Cl. ..... 220/4.09; 220/652

[58] Field of Search ..... 220/4.28, 4.29, 220/4.32, 4.33, 652

[56] References Cited

U.S. PATENT DOCUMENTS

| | | | |
|---|---|---|---|
| 744,300 | 11/1903 | Dailey | 220/652 |
| 746,511 | 12/1903 | Hottman, Jr. | 220/652 |
| 752,466 | 2/1904 | Pement | 220/652 |
| 961,522 | 6/1910 | Neblett | 220/652 |
| 4,193,510 | 3/1980 | Weston | 220/652 |
| 5,178,292 | 1/1993 | Korzeniowski | 220/652 |
| 5,392,946 | 2/1995 | Holbrook et al. | 220/652 |

*Primary Examiner*—Joseph M. Moy
*Attorney, Agent, or Firm*—Townsend and Townsend and Crew LLP

[57] ABSTRACT

In a so-called strapless bin erected on a pallet, normally open self locking clips are compressed during bin erection by the on fork bin sides to lock and hold adjacent right angle bin sides in the erected disposition. The two off pallet bin sides have peripheral self locking corner irons, with two such self locking corner irons being placed on either vertical side of the off pallet side with vertical inset returns at their extremity. There inset returns key to corresponding routed grooves formed exteriorly at the side vertical edges of the adjoining on pallet bin sides. An internally mounted normally open side supporting clip is placed on the interior of the off pallet side at a sufficient interval to snugly capture the on pallet exteriorly grooved side into the self locking corner irons of the off pallet side. When the on pallet side seats at the routed grooves to the inset return of the off pallet side, the spring clip opens, snugly locking the two bin sides at right angles in an erected configuration. Presuming that all four bin sides are erected and locked with the normally open side supporting clips, product is placed within the bin and a peripheral side retaining top seated to the top edge of the bin sides. A product containing bin having improved tear and impact resistance results.

8 Claims, 4 Drawing Sheets

APPARATUS AND PROCESS FOR ERECTING COLLAPSIBLE BIN

This disclosure relates to so-called strapless collapsible bins. Improvements are set forth that include clips that assist in the assembly of the collapsible bin and a top having peripheral side gripping rails to insure bin integrity upon transport.

BACKGROUND OF THE INVENTION

So-called strapless containers are known. See, Sims, U.S. Pat. No. 5,415,310, issued May 16, 1995 and assigned to the common assignee herein.

This invention can be easily summarized. A paste bin is disclosed in which the combination of self locking corner irons enable both the elimination of straps utilized to hold the containers together as well as the relatively complex pre-strapping assembly. Accordingly, self locking corner irons are placed on the off pallet sides of the container with two such self locking corner irons being on either vertical side of the off pallet side of the bin. Each of these corner irons consists of eleven gauge (⅛ inch) steel strips bent at 90° to form two longitudinally extending side capturing edges. The vertical dimension of the self locking corner irons is slightly less than all of the height of the sides. On the off pallet side, the edge of the corner irons includes punched intermittent annular inwardly protruding male flanges. These inwardly protruding annular male flanges are for receiving the heads of flat head machine screws for permanently fastening the self locking corner irons to the off pallet sides. The opposite bent edge of the self locking corner irons are fitted with returns, these returns constituting preferably 90° inward bends at the side edge of the strip edge. The purpose of these returns is to key to saw kerfs formed within adjoining bin sides. A corner locking mechanism temporarily holds the bin in the erected state until paste contents are placed within the erected bin. The entire construction when assembled and loaded with respect to the pallet having an upwardly exposed integral bottom, constitutes a self locking construction for the transport and storage of paste.

DISCOVERY

I have discovered that this design has instabilities. While these instabilities only occasionally appear, I list them here.

First, these bins are only strapless in that horizontal strapping is omitted. It has been found that during transport, where either jostling or dropping occurs, the inset return can tear the plys of the grooves along the plywood sides. Such tearing usually starts at a point of maximum stress—such as the top or the bottom of the self-locking corner iron. From this "start," further tearing propagates, not at all unlike a zipper opening.

Second, and surprisingly, bin collapse has occurred as the bin has been emptied. It was initially contemplated that corner shaped clamps fitting over the respective corners and holding the sides together would be sufficient. Unfortunately, these respective corner shaped clamps come loose when the bin is manipulated for emptying. Collapse has occurred when the bin is elevated, partially inverted and the product containing bag "dumped." Similarly, collapse has occurred when the product is pumped from a ruptured bag. Since the bin contains bags of fruit or vegetable paste, having the interior or the collapsible bins coated with dripping fruit and vegetable puree needlessly complicates product delivery.

TERMINOLOGY

For the convenience of this specification, and in referring to the particular sides of the bin disclosed, reference will be made to the terms "on pallet" and "off pallet." As those familiar with pallets readily know, such pallets are typically moved by fork lifts. These fork lifts can only penetrate spatial intervals on two opposite sides of a square pallet. Consequently, these opposite sides of a pallet will be hereinafter referred to as the "on pallet" sides. Similarly, those sides of the pallet—again two opposite sides—which cannot be penetrated by a fork lift—will be referred to as the "off pallet" sides.

It goes without saying that the bin sides appearing on the "on pallet" sides can be substituted for bin sides appearing on the "off pallet" sides. Accordingly, the Summary of Invention and Description of the Preferred Embodiment should be so understood.

SUMMARY OF THE INVENTION

In a so-called strapless bin assembled on a pallet, internally mounted, normally open, self locking clips on the off pallet sides are compressed during bin assembly by the on pallet bin sides to lock and hold adjacent right angle bin sides in the erected disposition. In this type of bin, erection occurs on a pallet. The two off pallet bin sides have peripheral self locking corner irons, with two such self locking corner irons being placed on either vertical side of the off pallet side. Each of these corner irons consists of eleven gauge (⅛ inch) steel strips bent at 90° to form two longitudinally extending side capturing edges. The side capturing edges have 90° vertical inset returns at their extremity. These inset returns key to corresponding routed grooves formed exteriorly at the side vertical edges of the adjoining on pallet bin sides. An internally mounted, normally open, side supporting clip is placed on the interior of the off pallet sides at a sufficient interval to snugly capture the on pallet exteriorly grooved side into the self locking corner irons of the off pallet sides. Assuming that at least one off pallet side is held erect on a supporting pallet, at least one on pallet side is placed at its base on the adjacent right angle edge of the pallet. The on pallet side is abutted interiorly of the bin at the fastened end of the normally open side supporting clip. It is then rotated along its vertical side edge at the inside edge of the off pallet side. This rotation causes its routed groove to register to the inset return of the self locking corner irons. During this rotation, elastic closing of the normally open side supporting clips occurs as the vertical side edge of the on pallet side passes over and compresses the normally open side supporting clip. Just as the on pallet side seats at the routed grooves to the inset return of the off pallet side, the spring clip opens, snugly locking the two bin sides at right angles in an erected configuration. Presuming that all four bin sides are erected and locked with the normally open side supporting clips, product is placed within the bin and a peripheral side retaining top seated to the top edge of the bin sides. A product containing bin having improved tear and impact resistance results.

DESCRIPTION OF THE PREFERRED EMBODIMENT

Figure 1B:
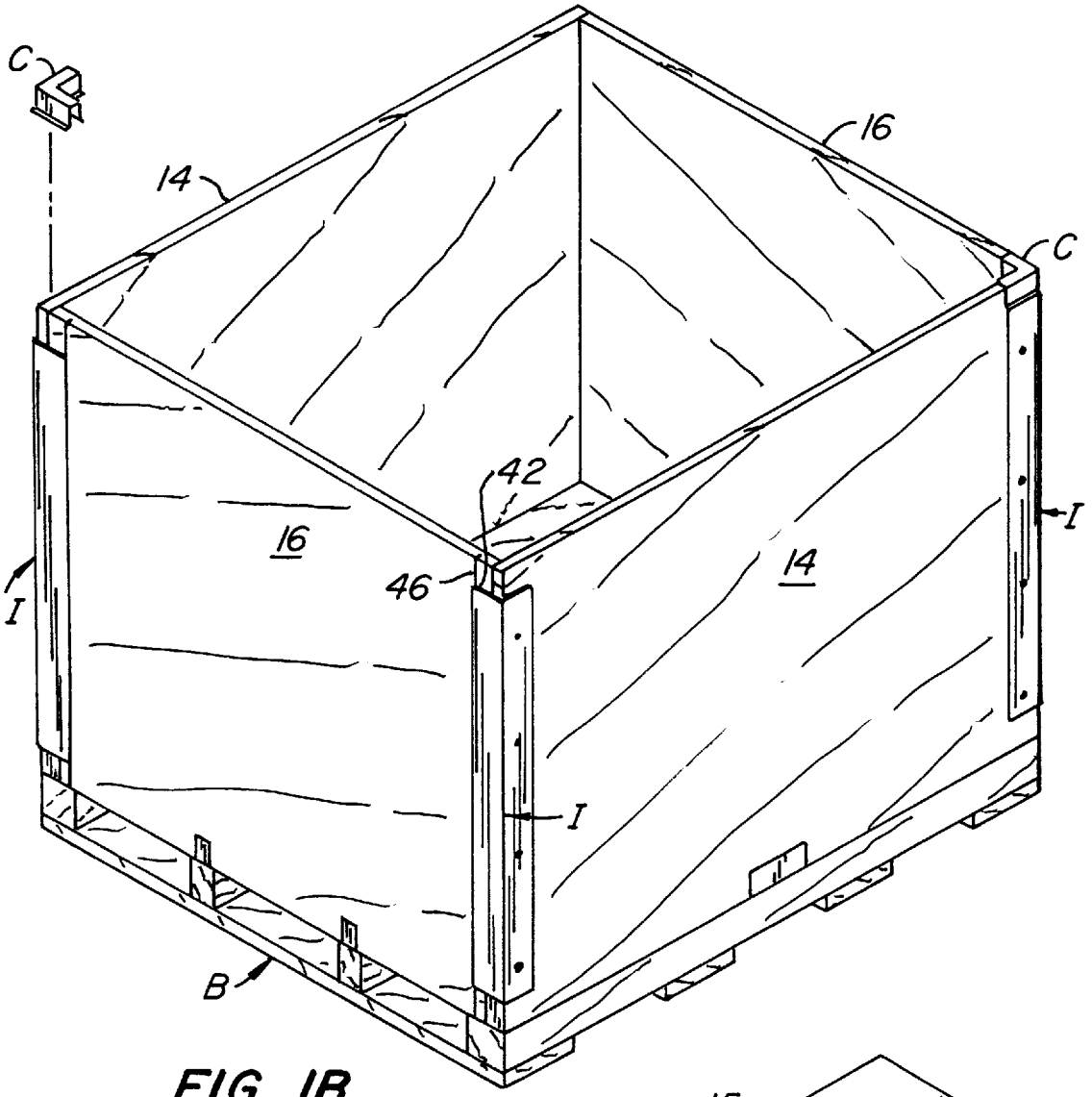
FIG. 1B. PRIOR ART
FIG. 1B illustrates the prior art bin in expanded detail with one of the prior art corner shaped clips shown in exploded relationship.
Figure 1A:
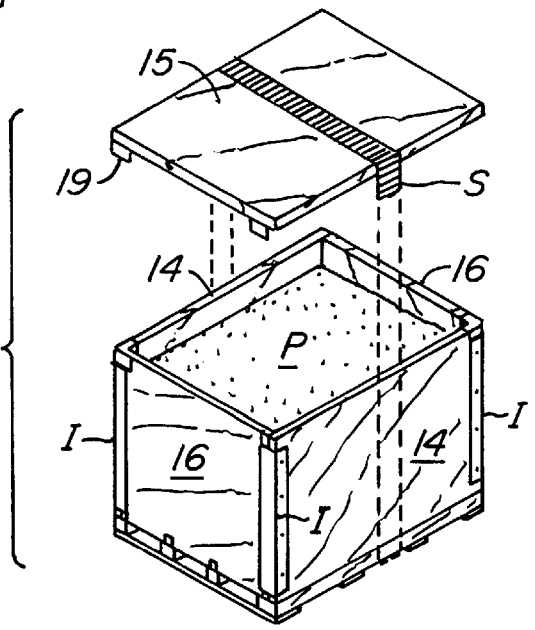
FIG. 1A. PRIOR ART
FIG. 1A is a reduced view of the prior art bin illustrating a bin containing product with an overlying lid in an exploded relation and a lid fastening strap schematically illustrated.

Referring to the reduced view of FIG. 1A and the larger view of FIG. 1B, the use of the bin can be referred to in the prior art embodiment shown. Specifically, on pallet sides 16 and off pallet sides 14 are shown erected on pallet B. Corner irons I have insets 42 which key to kerfs 46 on on pallet sides 16. Corner shaped clamps C key the respective on pallet sides 14 and off pallet sides 16 at the upper edge. Top 15 having centering battens 19 fit overlying the bin when assembled and filled with product P. For shipping purposes, a single vertical containment strap S is utilized.

The occasional problems I have encountered can be simply stated. First, and during jostling or jolting shipment—such as sharp drops—the plys of kerfs 46 effectively serially tear—with the tear usually propagating from one end of corner irons I to an opposite end. Further, when product P is removed, corner shaped clamps C come off—not unlike the specific exploded view of FIG. 1B. When this occurs—and the bin is either inverted or pumped empty of product, on pallet sides 16 fall inwardly, aggravating the unloading process. Simply stated, when corner shaped clamps C fall free, bin disassembly occurs.

Having set forth the prior and occasional difficulties encountered, I now attend to their solution.

Figure 2:
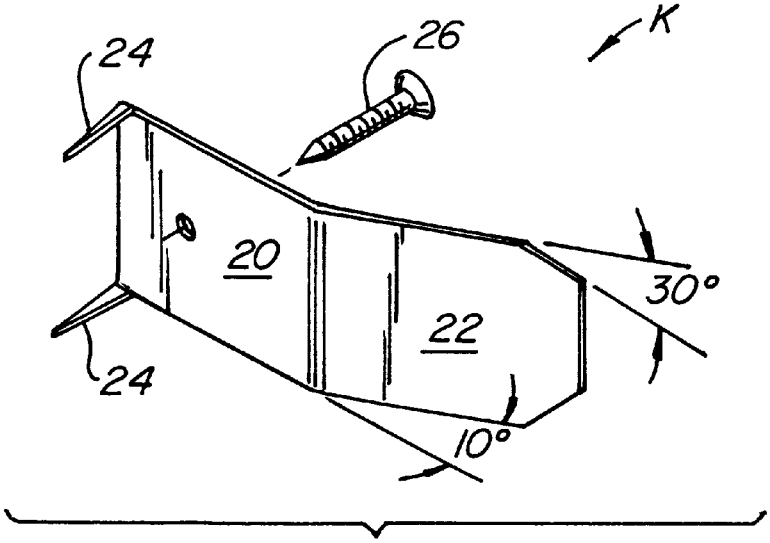
FIG. 2 is an enlarged view of the clip of this invention illustrating the fastening portion of the clip with the spring biased portion of the clip normally disposed out of the plane of the fastening portion of the clip.
Figure 3:
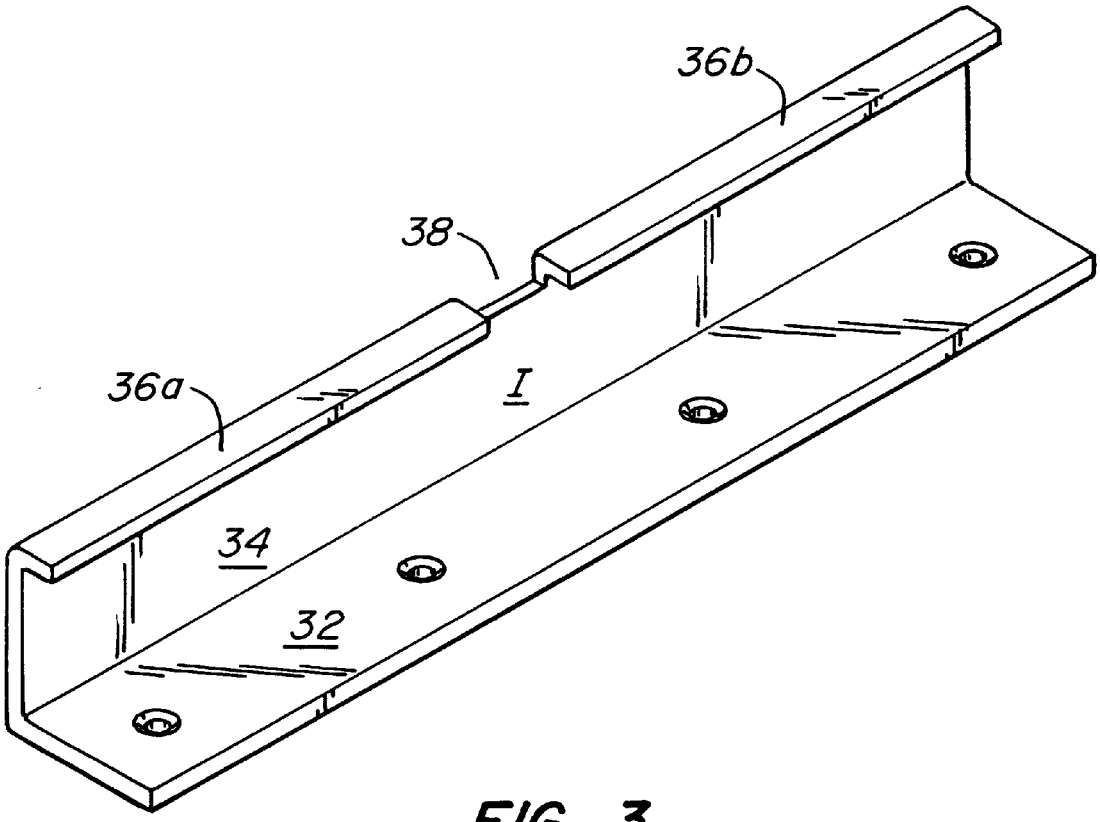
FIG. 3 is a prospective view of a self locking corner iron, it being noted that the corner iron includes two spaced apart inset returns.

Referring to FIG. 2, spring clamp K is illustrated having mounting portion 20 and spring portion 22. Mounting portion 20 has two bent tangs 24 which are at right angles to the mounting portion and serve to center the mounting portion when it is secured to the inner surface of off pallet sides 14 by fastening screw 26. Thus, when spring clamp K is affixed to the inside edge of off pallet sides 14, rotation of spring clamp K on fastening screw 26 cannot occur.

Referring further to FIG. 2, it will be seen that spring portion 22 is normally bent out of the plane of mounting portion 20 by only a slight angle, that angle being illustrated in the order of 10°. Further, it will be seen that distal end 28 of spring clamp K is provided with two 30° tapers 30. These tapers—together with the shallow bend of spring portion 22 relative to mounting portion 20 prevent spring clamp K from entangling or tearing any bag containing product P within the bin. I only note for the record that some producers prefer to place corner liners in this interval; generally the disclosed design of spring clamp K makes this unnecessary.

Figure 4:
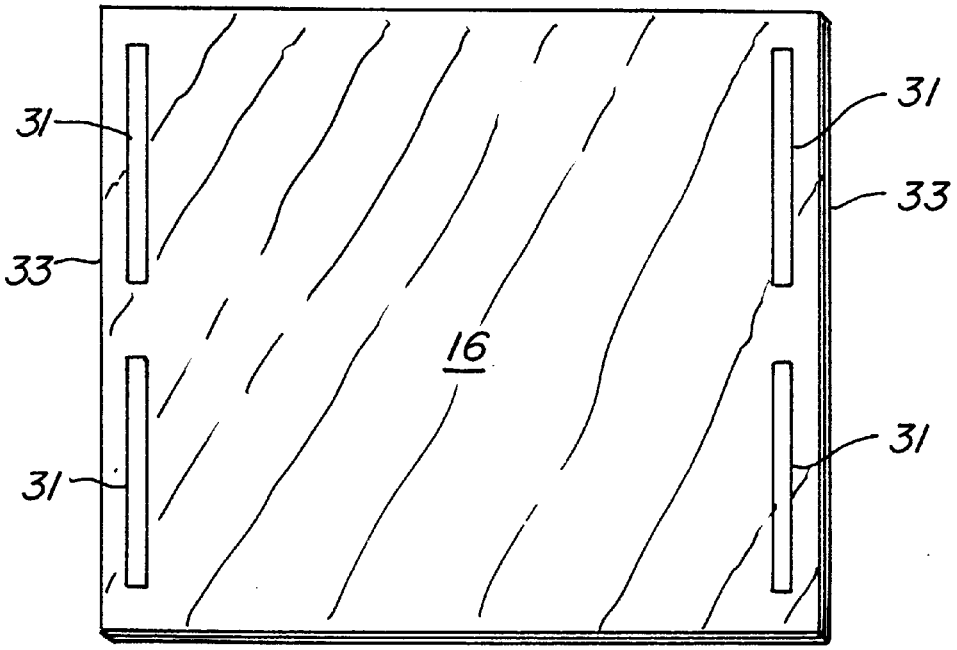
FIG. 4 is an exterior view of the on pallet container side illustrating paired routed grooves on each vertical edge, these routed grooves corresponding in placement and size to the inset returns of the self locking corner irons.
Figure 5:
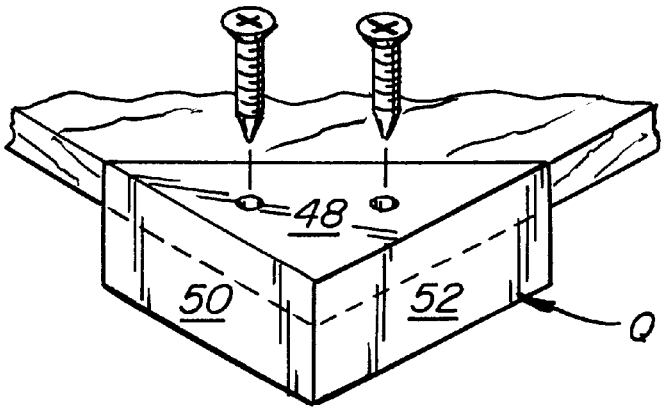
FIG. 5 is a detail of the container top illustrating corner clips utilized in supplying resistance at the top of the container from outward expansion of the sides; and, FIG. 6 is a erected view of the container illustrating in expanded scale the normally open self supporting side clip holding an on pallet side securely locked to the self locking corner iron with the top having a top with peripheral containment corner clips being shown overlying the bin in exploded relationship.

Referring to FIGS. 2 and 4, it will be seen that corner irons I have been slightly improved in this preferred embodiment. I no longer utilize continuous kerfs 46. Instead, and referring to FIG. 4, on pallet side 16 is provided to two routed grooves 31 on vertical side edges 33. This discontinuous routing through the use of a standard wood router eliminates stress points and provides rounded surfaces to the ends and bottoms of routed grooves 31; this generally assists in inhibiting propagation of ply tearing.

I have similarly modified corner irons I. Specifically, I still maintain iron side 32 fastened to the exterior of off pallet sides 14, iron bottom 34 extending across edge of off pallet sides 14 with two inset returns 36*a* and 36*b* separated by spatial interval 38. It thus can be understood how inset returns 36*a* and 36*b* fasten interiorly of routed grooves 31.

Additionally, I have provided that top 15 have top corner clips Q. These respective sheet metal top corner clips Q extend from the corner of top 15 downward over and beyond the edge of top 15. In this position, they engage the outside edges of off pallet sides 14 and on pallet sides 16 at their upper end and provide resistance against outward expansion of the bin sides. Specifically, top corner clips Q include top triangular section 48, first side section 50 and second side section 52. When these three sections are joined in a single unitary top with corner clips Q, reinforced fastening of top 15 to off pallet sides 14 and on pallet sides 16 results.

Figure 6:
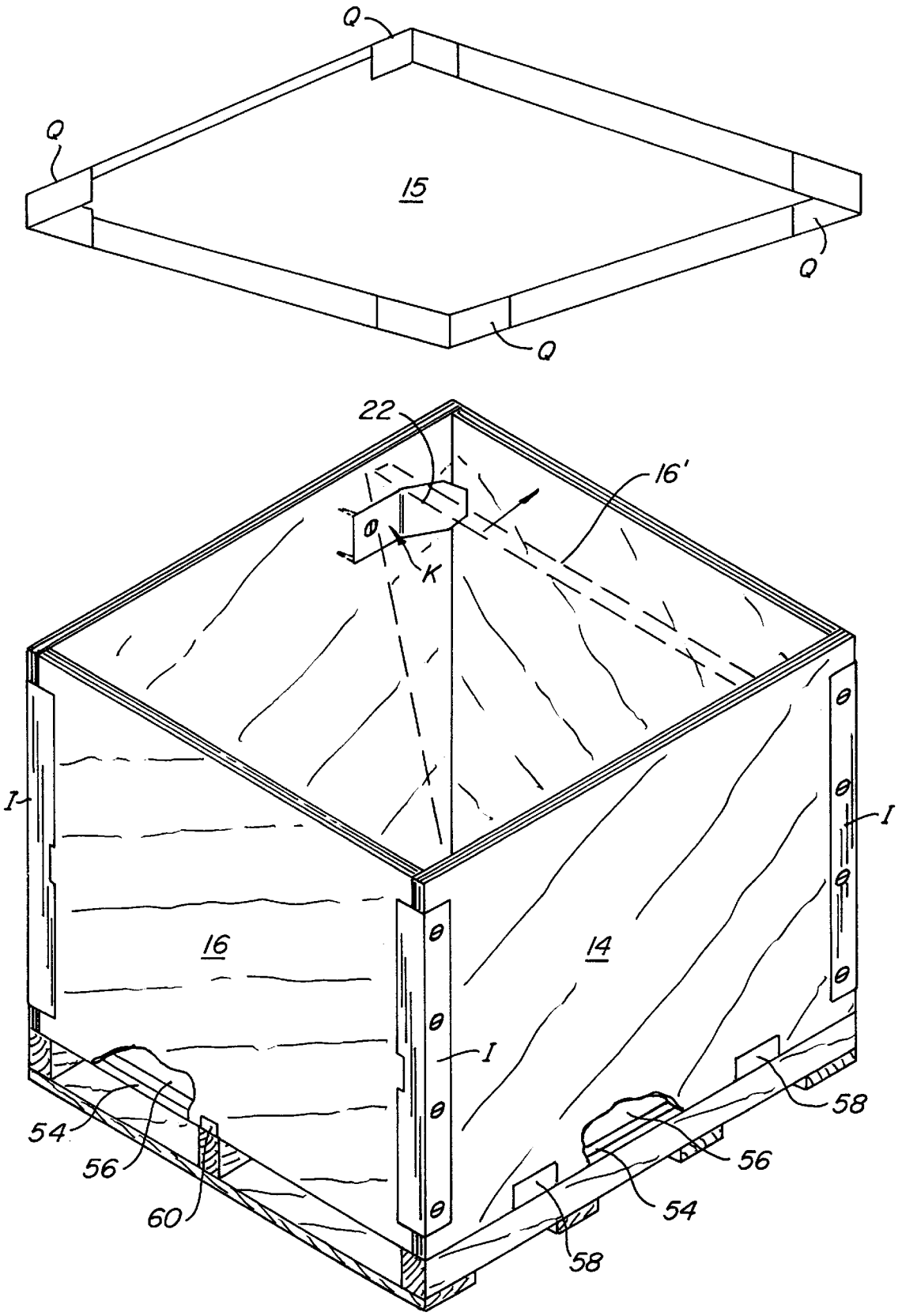

Referring to FIG. 6, attention will first be directed to pallet B. First, and as in previous Sims, U.S. Pat. No. 5,415,310, issued May 16, 1995, pallet B includes inset edges 54. These respective inset edges 54 receive the bottom of off pallet sides 14 and on pallet sides 16 flush to the inset pallet bottom 56. As before, the bottom edge of off pallet sides 14 is held in place by off pallet side guide 58 and the bottom edge of on pallet sides 16 held by on pallet side guide 60. Thus, the reader can understand that the bottom edges of the bin sides are held firmly in place.

Second, erection of one on pallet side 16' to one off pallet side 14 can be understood from on pallet side 16' being shown in broken lines in FIG. 6. The reader should understand that spring clamp K is here shown in expanded scale so that the reader can understand its function.

In erection of on pallet sides 16', only one off pallet side 14 need be held in the erect position. Further, an unlike the prior art, this assembly can use one man. By simply holding one off pallet side on pallet B 14 vertical, and juxtaposing on pallet side 16' pallet B behind spring clamp K, rotational motion of on pallet side 16' depresses spring portion 22 of spring clamp K. Spring clamp K is spaced from corner irons I as sufficient a distance so that once inset returns 36*a* and 36*b* fasten to interior of routed grooves 31, spring portion 22 of spring clamp K locks the two sides in their right angle relationship. Once this has occurred, the remaining off pallet sides 14 can be slid into place, this sliding occurs along the bottom of pallet B in the groove defined at inset edges 54. Thereafter, the final on pallet side 16 can be rotated into place, in an operation easily accomplished by one man.

Presuming that the bin is assembled, top 15 can be placed over the bin with top corner clips Q in effect keying to and holding the sides into place. With fastening of single vertical containment strap S, the bin is ready for shipping.

The reader will understand that I disclose both a new clip and a process of bin assembly utilizing the new clip. This clip has been found fully compatible with the required erection as well as the required integrity of the bin in containing product as shipped.

What is claimed is:

1. A strapless bin erected on a pallet comprising:

a pallet;

two first bin sides, each first bin side having a top horizontal edge at the top of the bin, a bottom horizontal edge at the pallet, and two vertical side edges for adjoining adjacent bin sides;

peripheral self locking corner irons at the vertical side edges of the first bin sides;

vertical inset returns at an extremity of the peripheral self locking corner irons;

two second bin sides, each second bin side having a top horizontal edge at the top of the bin, a bottom horizontal edge at the pallet, and two vertical side edges for adjoining adjacent bin sides;

routed grooves on an exterior surface of the second bin sides, each routed groove defining an interval for receiving the vertical inset returns of the extremity of the peripheral self locking corner irons;

at least two internally mounted normally open side supporting clips, each clip including a mounting portion for flush fastening to a first bin side and a spring biased opening end for protruding outwardly for engagement with second bin side;

each internally mounted normally open side supporting clip placed on an interior surface of the first bin sides with the spring biased opening end protruding to engage a second side, the internally mounted normally open side supporting clip placed at a sufficient interval from the self locking corner iron to snugly capture the second sides at the routed grooves into the inset returns of the self locking corner irons of the first pallet sides.

2. A strapless bin erected on a pallet according to claim 1 and further comprising:

the side supporting clip is a metal spring clip constructed of 18 gauge strapping material formed in a dye.

3. A strapless bin erected on a pallet according to claim 1 and further comprising:

a top, the top having containment for the first and second sides at a peripheral edge of the top to engage the exterior of the first and second sides.

4. A process of the self locking erection of a strapless bin using normally open self locking clips to hold the strapless bin erected on a pallet comprising the steps of:

providing a pallet;

providing two first bin sides, each first bin side having a top horizontal edge at the top of the bin, a bottom horizontal edge at the pallet, and two vertical side edges for adjoining adjacent bin sides;

providing and placing peripheral self locking corner irons at the vertical side edges of the first bin sides with vertical inset returns at an extremity of the peripheral self locking corner irons;

providing two second bin sides, each second bin side having a top horizontal edge at the top of the bin, a bottom horizontal edge at the pallet, and two vertical side edges for adjoining adjacent bin sides;

placing grooves on an exterior surface of the second bin sides, each placed groove defining an interval for receiving the vertical inset returns of the extremity of the peripheral self locking corner irons;

providing at least two internally mounted normally open side supporting clips, each clip including a mounting portion for flush fastening to a first bin side and a spring biased opening end for protruding outwardly for engagement with second bin side;

placing each internally mounted normally open side supporting clip placed on an interior of the first bin sides with the spring biased opening end protruding to engage a second side, the internally mounted normally open side supporting clip placed at a sufficient interval from the self locking corner iron to snugly capture the second sides at the routed grooves into the inset returns of the self locking corner irons of the first pallet sides;

depressing the clip to the open position while moving at least one first side into engagement with at least one second side to register the inset returns with the grooves; and, locking the clip to hold at least one first side into engagement with at least one second side.

5. A process of self locking erection of a strapless bin according to claim 4 and including the further steps of:

placing a second one of the first bin sides into engagement with the inset returns of the corner irons of the first bin side to lock two first bin sides and one second bin side in self erected relation.

6. A process of the self locking erection of a strapless bin according to claim 5 and including the further steps of:

placing a second of the second bin sides into engagement with the two first bin sides to erect two first bin sides and two second bin sides in self locking engagement.

7. In a bin having in combination;

a pallet bottom having fork receiving second pallet sides formed with an integral upwardly exposed bin bottom;

paired first pallet sides for fitting to the pallet bottom at the first pallet sides of the bin bottom;

paired second pallet sides for fitting to the pallet bottom at the second pallet sides of the bin bottom;

a top having side spacing downward exposed cleats for receiving and spacing the respective paired second pallet and first pallet sides;

four self locking corner irons, each said iron comprising in combination;

an elongate strip bent to an approximate 90° angle for forming a first first pallet side contacting portion and a second second pallet side contacting portion;

one of the side contacting portions including means for permanently fastening to one of the bin sides;

the other of the side contacting portions including means for keying to the other of the bin sides; and, key receiving means defined second the outside edge of the other of the bin sides whereby when the self locking corner irons are affixed to the one of the sides and the other of the sides is biased into the self locking corner irons, the container is maintained in an erected self locking disposition the improvement in the bins comprising in combination:

at least two internally mounted normally open side supporting clips, each clip including a mounting portion for flush fastening to a first bin side and a spring biased opening end for protruding outwardly for engagement with second bin side, wherein each internally mounted normally open side supporting clip placed on an interior of the first bin sides with the spring biased opening end protruding to engage a second side, the internally mounted normally open side supporting clip placed at a sufficient interval from the self locking corner iron to snugly capture the second sides at the routed grooves into the inset returns of the self locking corner irons of the first pallet sides.

8. In a bin according to claim 7 and wherein:

the key receiving means defined on the outside edge of the other of the bin sides includes at least one routed groove.

5,918,755
7 8

* * * * *